US005599656A

United States Patent [19]

Michno et al.

[11] Patent Number: 5,599,656

[45] **Date of Patent: *Feb. 4, 1997**

[54] PHOTOGRAPHIC MATERIALS HAVING RELEASABLE COMPOUNDS

[75] Inventors: Drake M. Michno, Webster; Richard P. Szajewski, Rochester; Stephen P. Singer, Spencerport, all of N.Y.

[73] Assignee: Eastman Kodak Company, Rochester, N.Y.

[ * ] Notice: The portion of the term of this patent subsequent to Mar. 27, 2007, has been disclaimed.

[21] Appl. No.: 563,725

[22] Filed: Aug. 6, 1990

Related U.S. Application Data

[63] Continuation-in-part of Ser. No. 209,613, Jun. 21, 1988, abandoned.

[51] Int. Cl.[6] ..... G03C 7/305; G03C 7/32

[52] U.S. Cl. ..... 430/382; 430/393; 430/544; 430/549; 430/955; 430/957

[58] Field of Search ..... 430/382, 393, 430/544, 549, 955, 957

[56] References Cited

U.S. PATENT DOCUMENTS

| | | | |
|---|---|---|---|
| 4,248,962 | 2/1981 | Lau | 430/382 |
| 4,293,691 | 10/1981 | Furutachi et al. | 544/140 |
| 4,409,323 | 10/1983 | Sato et al. | 430/544 |
| 4,421,845 | 12/1983 | Uemura et al. | 430/544 |
| 4,842,994 | 6/1989 | Sakanoue et al. | 430/543 |
| 4,912,024 | 3/1990 | Michno et al. | 430/544 |
| 4,959,299 | 9/1990 | Sakanoue et al. | 430/544 |
| 4,962,018 | 10/1990 | Szajewski et al. | 430/544 |

FOREIGN PATENT DOCUMENTS

| | | |
|---|---|---|
| 0193389 | 3/1986 | European Pat. Off. . |
| 149359 | 8/1984 | Japan . |
| 070239 | 3/1988 | Japan . |
| 070851 | 3/1988 | Japan . |
| 070852 | 3/1988 | Japan . |
| 070853 | 3/1988 | Japan . |

*Primary Examiner*—Janet C. Baxter
*Attorney, Agent, or Firm*—Joshua G. Levitt

[57] ABSTRACT

Photographic elements are disclosed having a first coupler represented by the formula:

$COUP_1$-T-INH wherein $COUP_1$ is a coupler moiety,

T is a timing group bonded to INH through a substituted or unsubstituted methylene group contained in T and bonded to $COUP_1$ through an O, S, or N atom contained in T, and INH is a development Inhibitor moiety, and wherein the T-INH group is able to undergo electron transfer along a conjugated system therein to cleave INH after T-INH is cleaved from $COUP_1$, and a second coupler represented by the formula:

$COUP_2$-$(TIME)_n$-S-$R_1$-$R_2$ wherein $COUP_2$ is a coupler moiety, TIME is a timing group, n is 0 or 1, $R_1$ is a divalent linking group that does not include a heterocyclic ring attached directly to S, and $R_2$ is a water solubilizing group.

23 Claims, No Drawings

PHOTOGRAPHIC MATERIALS HAVING RELEASABLE COMPOUNDS

This is a continuation-in-part of application Ser. No. 209,613, filed Jun. 21, 1988 now abandoned.

FIELD OF THE INVENTION

This invention relates to photographic materials and elements, specifically to materials and elements having a coupler that releases a development inhibitor compound and another coupler that releases another releasable compound.

BACKGROUND OF THE INVENTION

Development inhibitor releasing compounds or couplers (DIR's) are compounds that release development inhibitor compounds upon reaction with oxidized developer. DIR's are used in photographic materials to improve image sharpness (acutance), reduce gamma-normalized granularity (a measure of signal to noise ratio with a low gamma-normalized granularity indicating a beneficial high signal to noise ratio), control tone scale, and control color correction.

It is often desirable to maximize the amount of sharpness obtained from a DIR that is incorporated in a photographic element. One way this is accomplished is by increasing the mobility of the DIR without significantly increasing the quantity incorporated. This can be accomplished through the use of a timing group, which cleaves from the inhibitor only after a delay, during which the timing-inhibitor moiety can move in the material. An example of such a timed DIR is:

D-1

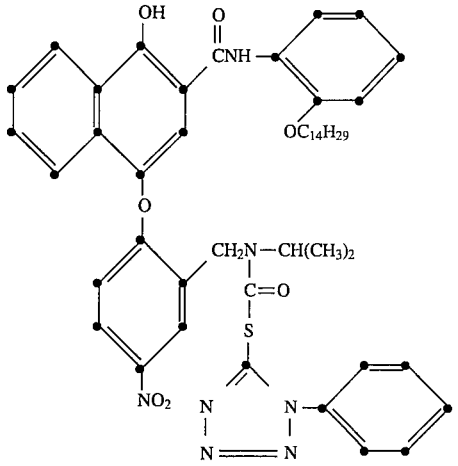

Another timed DIR, as taught in U.S. Pat. No. 4,409,323, releases a timing group from the DIR inhibitor fragment some time after the fragment is cleaved from the coupler by undergoing electron transfer along a conjugated system. These DIR's, however, do not provide reductions in gamma-normalized granularity to the extent that is often desirable.

It would therefore be highly desirable to provide a photographic material that offered the concommitant advantages of high image sharpness, low interlayer interimage effect, and low gamma-normalized granularity.

In an unrelated area, it has been taught to incorporate bleach accelerator-releasing compounds (BARC's) in photographic materials to aid in the bleaching step of photographic processing. European Patent Application Publication No. 193,389 discloses BARC's having a releasable thioether bonded to an alkylene group or heterocyclic nucleus with a solubilizing group attached thereto. One such BARC, having the formula:

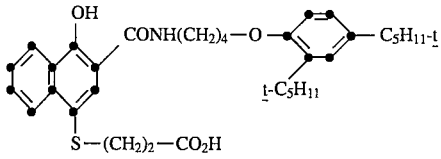

has been used as such in a color negative film, which also contained the above-identified DIR, D-1, which does not cleave the timing group from the inhibitor fragment by electron transfer along a conjugated system. This combination, as shown below by comparative data, did not provide as great a reduction in gamma-normalized granularity (from that provided by the DIR alone) as might be desired.

It has now been found that a specific subset of a class of compounds previously believed to be useful only as BARC's, allows for greater amounts of DIR's while maintaining the degree of color correction, and can provide the advantages of low interlayer interimage effect, high image sharpness, and low gamma-normalized granularity when used in combination with the above-described ballasted inhibitor-releasing compounds.

SUMMARY OF THE INVENTION

According to the present invention, there is provided a photographic element having at least one layer comprising a photographic silver halide emulsion. In reactive association with the emulsion is a first coupler (A) that is represented by the formula (I):

$$COUP_1\text{-}T\text{-}INH$$

wherein $COUP_1$ is a coupler moiety, T is a timing group bonded to INH through a substituted or unsubstituted methylene group contained in T and bonded to $COUP_1$ through an O, S, or N atom contained in T, and INH is a development inhibitor moiety, and wherein the T-INH group is able to undergo electron transfer along a conjugated system therein to cleave INH after T-INH is cleaved from $COUP_1$. Also in reactive association with the emulsion is a second coupler (B) represented by the formula (II):

$$COUP_2\text{-}(TIME)_n\text{-}S\text{-}R_1\text{-}R_2$$

wherein $COUP_2$ is a coupler moiety, TIME is a timing group, n is 0 or 1, $R_1$ is a divalent linking group that does not include a heterocyclic ring attached directly to S, and $R_2$ is a water solubilizing group.

The combination of couplers (A) and (B) provides photographic elements with low interlayer interimage effect, high image sharpness, and low gamma-normalized granularity. When used with coupler (A), coupler (B) provides greater improvements in gamma-normalized granularity than when used with other DIR's.

DESCRIPTION OF THE PREFERRED EMBODIMENTS

With regard to coupler (A), the term "conjugated system" is a well-known term in organic chemistry referring to compounds where a single bond and a double or triple bond appear alternately in the chemical formula. The electron transfer is enabled by a lone pair electron on the -T-INH fragment after being cleaved from $COUP_1$ that transfers along a conjugated system to break the bond between T and INH. Such systems and couplers utilizing them are described in U.S. Pat. Nos. 4,409,323, 4,456,073, 4,698,297, and 4,528,263, the disclosures of which is incorporated herein by reference.

In a preferred embodiment, T forms a quinonemethide or naphthoquinonemethide after cleavage from INH, with the coupler (A) being represented by the formula:

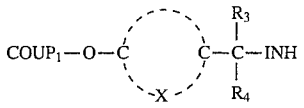

where X represents the atoms necessary to complete a substituted or unsubstituted benzene or naphthalene nucleus and $R_3$ and $R_4$ each independently represents H, alkyl, or aryl, and the

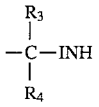

group is ortho or para relative to the oxygen atom.

Examples of -T-INH include the following:

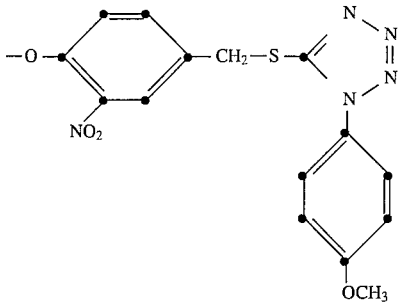

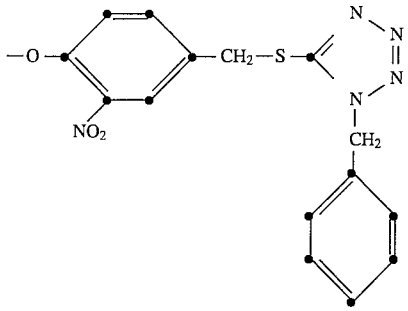

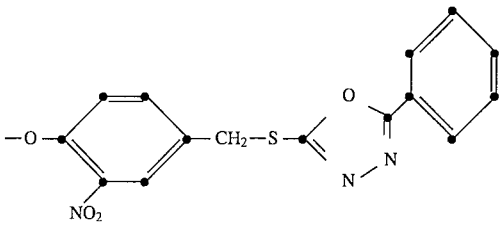

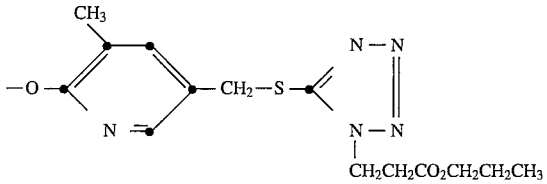

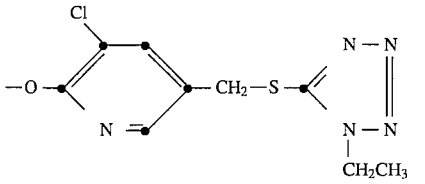

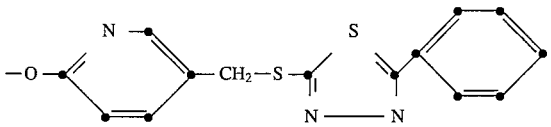

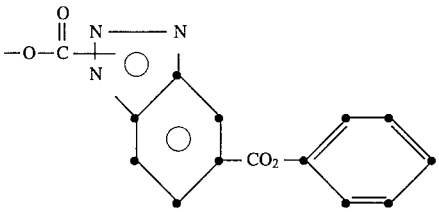

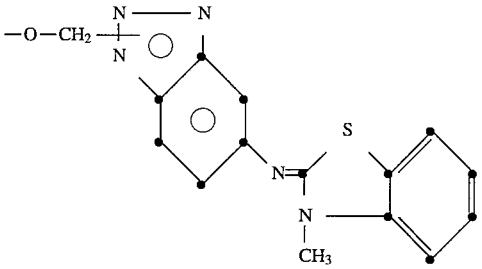

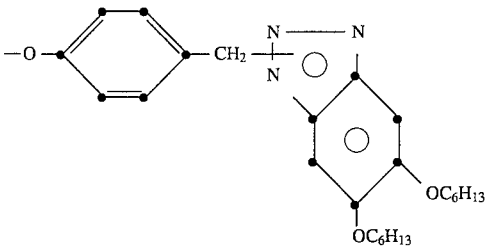

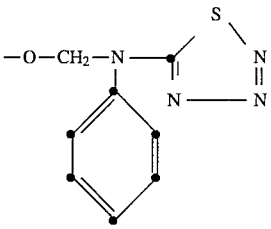

-continued
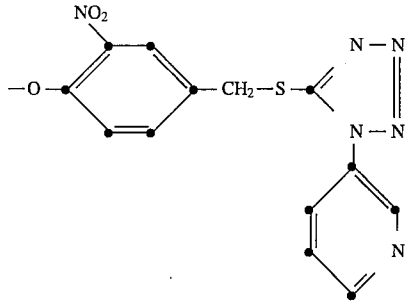
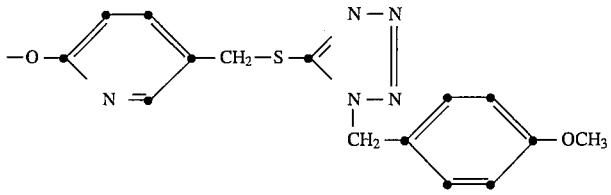
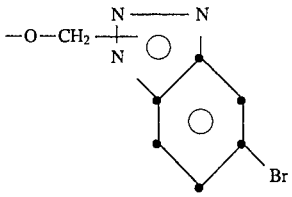
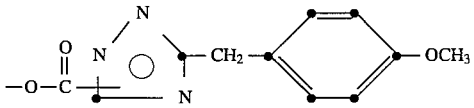
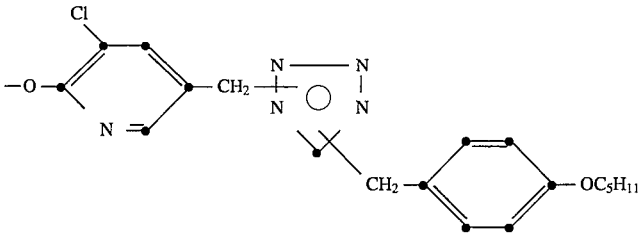
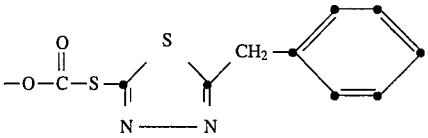
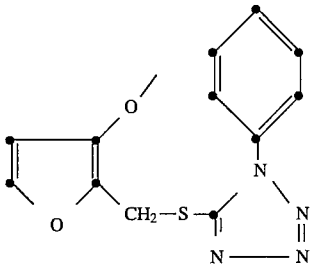
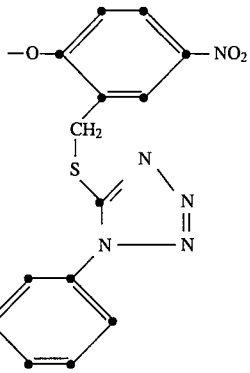
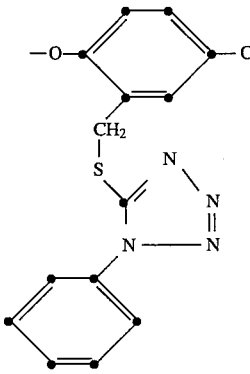

-continued

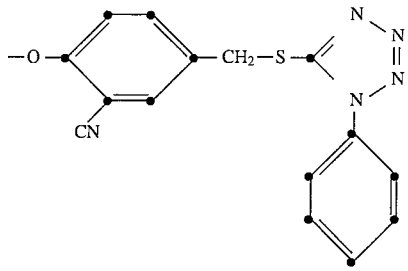

In one preferred embodiment, -T- is:

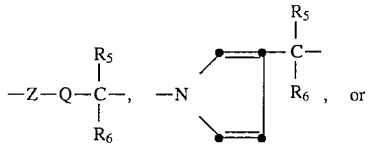

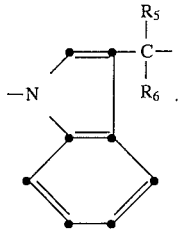

where -Z- is —O—, —S—, or

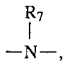

$R_5$, $R_6$, and $R_7$ are each independently hydrogen, alkyl, or aryl, and

Q is a 1,2- or 1,4-phenylene or naphthylene group.

One preferred example of -T- is:

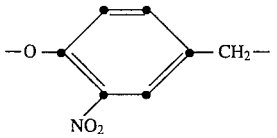

Coupler (A) is represented by formula (I) wherein $COUP_1$ is a coupler moiety. As used herein the terms "coupler" and "coupler compound" refer to the entire compound, including the coupler moiety, the timing group, and the inhibitor moiety, while the term "coupler moiety" refers to the portion of the compound other than the timing group and the inhibitor moiety.

The coupler moiety can be any moiety that will react with oxidized color developing agent to cleave the bond between the timing group and the coupler moiety. It includes coupler moieties employed in conventional color-forming couplers that yield colorless products, as well as coupler moieties that yield colored products on reaction with oxidized color developing agents. Both types of coupler moieties are known to those skilled in the photographic art.

The coupler moiety can be unballasted or ballasted with an oil-soluble or fat-tail group. It can be monomeric, or it can form part of a dimeric, oligomeric or polymeric coupler, in which case more than one INH group can be contained in the coupler, or it can form part of a bis compound in which the timing and inhibitor groups form part of the link between two coupler moieties.

It will be appreciated that, depending upon the particular coupler moiety, the particular color developing agent and the type of processing, the reaction product of the coupler moiety and oxidized color developing agent can be: (1) colored and nondiffusible, in which case it will remain in the location where it is formed; (2) colored and diffusible, in which case it may be removed during processing from the location where it is formed or allowed to migrate to a different location; or (3) colorless and diffusible or nondiffusible, in which case it will not contribute to image density. In cases (2) and (3) the reaction product may be initially colored and/or nondiffusible but converted to colorless and/or diffusible products during the course of processing.

The timing group, T, is joined to the coupler moiety at any of the positions from which groups released from couplers by reaction with oxidized color developing agent can be attached. Preferably, the timing group is attached at the coupling position of the coupler moiety so that upon reaction of the coupler with oxidized color developing agent the timing group will be displaced. However, the timing group can be attached to a non-coupling position of the coupler moiety from which it will be displaced as a result of reaction of the coupler with oxidized color developing agent. In the case where the timing group is at a non-coupling position of the coupler moiety, other groups can be in the coupling position, including conventional coupling-off groups or the same or different inhibitor moieties from that contained in the described inhibitor moiety of the invention. Alternatively, the coupler moiety can have a timing and inhibitor group at each of the coupling position and a non-coupling position. Accordingly, couplers of this invention can release more than one mole of inhibitor per mole of coupler. Each of these inhibitors can be the same or different and can be released at the same or different times and rates.

There follows a listing of patents and publications that describe representative useful $COUP_1$ groups. In these structures, Y represents -T-INH as described. In the case of dye-forming couplers that are useful with a coupler (A), the Y group represents hydrogen or a coupling-off group known in the photographic art.

I. COUP's

A. Couplers that form cyan dyes upon reaction with oxidized color developing agents are described in such representative patents and publications as: U.S. Pat. Nos. 2,772,162, 2,895,826, 3,002,836, 3,034,892, 2,474,293, 2,423,730, 2,367,531, 3,041,236 and "Farbkuppler-eine Literatureübersicht," published in Agfa Mitteilungen, Band III, pp. 156–175 (1961).

Preferably such couplers are phenols and naphthols that form cyan dyes on reaction with oxidized color developing agent and have the coupling-off group attached at the coupling position, that is the carbon atom in the 4-position. Structures of such coupler moieties include:

IA-1

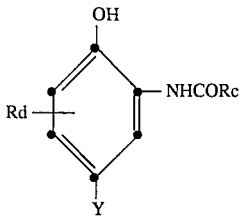

IA-2

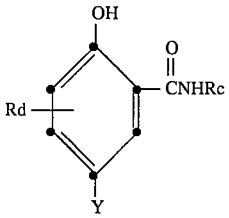

IA-3

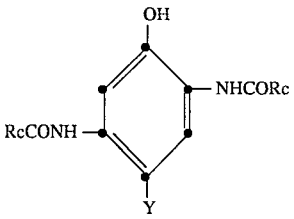

IA-4

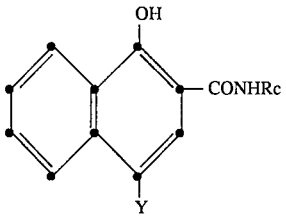

where Rc represents a ballast group, and Rd represents one or more halogen such as chloro or fluoro, lower alkyl containing 1 to 4 carbon atoms, such as methyl, ethyl, or butyl; or alkoxy containing 1 to 4 carbon atoms, such as methoxy, ethoxy, or butoxy groups.

B. Couplers that form magenta dyes upon reaction with oxidized color developing agent are described in such representative patents and publications as: U.S. Pat. Nos. 2,600,788, 2,369,489, 2,343,703, 2,311,082, 3,152,896, 3,519,429, 3,062,653, 2,908,573 and "Fabkuppler-eine Literatureübersicht," published in Agfa Mitteilungen, Band III, pp. 126–156 (1961).

Preferably, such couplers are pyrazolones, pyrazolotriazoles, or pyrazolobenzimidazoles that form magenta dyes upon reaction with oxidized color developing agents and have the Y attached to the coupling position. Structures of preferred such coupler moieties are:

IB-1

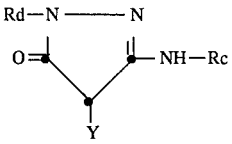

-continued

IB-2

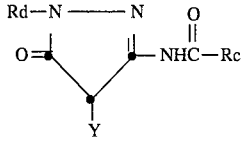

IB-3

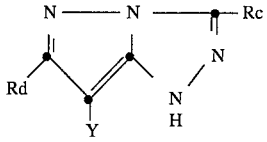

IB-4

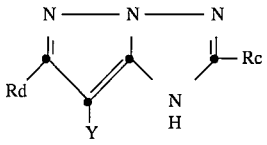

where Rc and Rd are chosen independently to be a ballast group, unsubstituted or substituted alkyl, unsubstituted or substituted phenyl.

C. Couplers that form yellow dyes upon reaction with oxidized and color developing agent are described in such representative patents and publications as: U.S. Pat. Nos. 2,875,057, 2,407,210, 3,265,506, 2,298,443, 3,048,194, 3,447,928 and "Farbkuppler-eine Literatureübersicht," published in Agfa Mitteilungen, Band III, pp. 112–126 (1961).

Preferably such yellow-dye forming couplers are acylacetamides, such as benzoylacetanilides and have the Y group attached to the coupling position, that is the active methylene carbon atom.

Structures of preferred such coupler moieties are:

IC-1

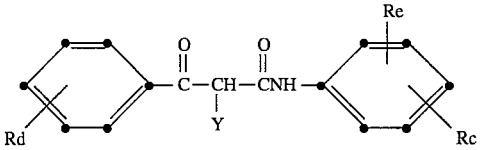

IC-2

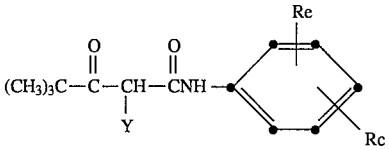

where Rc is as defined above for magenta dye-forming couplers and Rd and Re are hydrogen or one or more halogen, alkyl containing 1 to 4 carbon atoms, such as methyl and ethyl, or ballast groups, such as alkoxy of 16 to 20 carbon atoms.

D. Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Preferably such couplers are cyclic carbonyl containing compounds that form colorless products on reaction with oxidized color developing agent and have the Y group attached to the carbon atom in the α-position with respect to the carbonyl group.

Structures of preferred such coupler moieties are:

ID-1

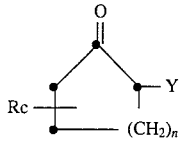

ID-2

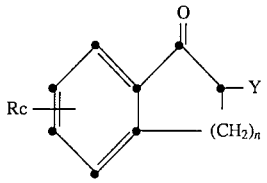

ID-3

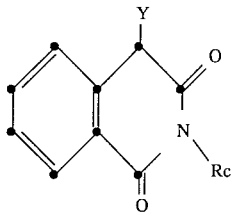

ID-4

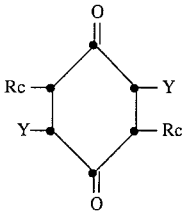

where Rc is as defined above for magenta dye-forming couplers and n is 1 or 2.

E. Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764.

Preferably such couplers are resorcinols or m-aminophenols that form black or neutral products on reaction with-oxidized color developing agent and have the Y group para to a hydroxy group.

Structures of preferred such coupler moieties are:

IE-1

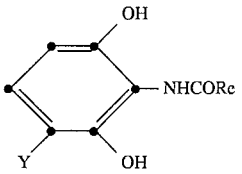

IE-2

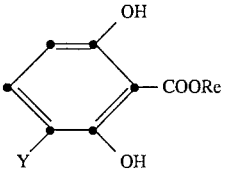

-continued

IE-3

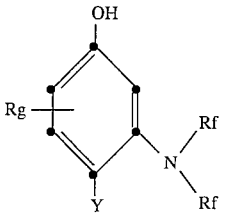

where Re is alkyl of 3 to 20 carbon atoms, phenyl or phenyl substituted with hydroxy, halo, amino, alkyl of 1 to 20 carbon atoms or alkoxy of 1 to 20 carbon atoms; each Rf is independently hydrogen, alkyl of 1 to 20 carbon atoms, alkenyl of 1 to 20 carbon atoms, or aryl of 6 to 20 carbon atoms; and Rg is one or more halogen, alkyl of 1 to 20 carbon atoms, alkoxy of 1 to 20 carbon atoms or other monovalent organic groups.

The INH group can be any of a number of inhibitor moieties that are well-known in the art. Useful inhibitor moieties heterocyclic groups derived from such compounds as mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzotriazoles and benzodiazoles. These inhibitor moieties may be unballasted or they may preferably be ballasted as taught, for example, in the U.S. Patent Application entitled, "Photographic Materials and Process", filed concurrently herewith in the names of R. P. Szajewski, J. N. Poslusny, and W. K. Slusarek.

Typical examples of useful inhibitor groups (INH) are as follows. In each of the examples, $R^1$ represents an optional ballast group.

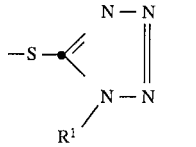

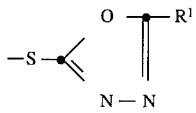

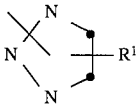

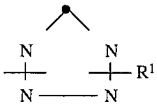

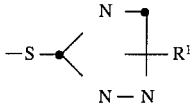

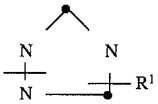

-continued

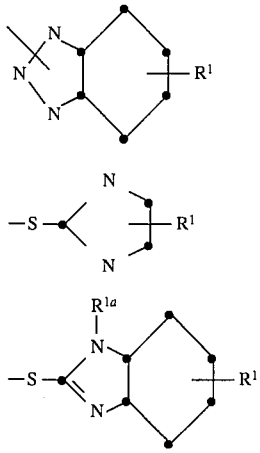

wherein $R^1a$ is hydrogen or an unsubstituted or substituted hydrocarbon group, such as methyl, ethyl, propyl, n-butyl, or phenyl.

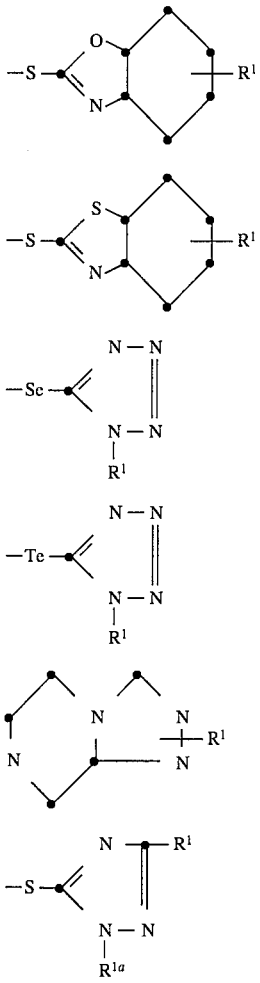

wherein $R^{1a}$ is hydrogen or an unsubstituted or substituted hydrocarbon group, such as methyl, ethyl, propyl, n-butyl, or phenyl.

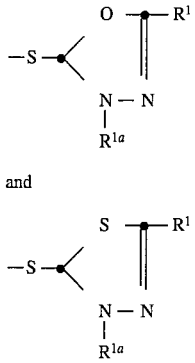

and wherein $R^{1a}$ is hydrogen or an unsubstituted or substituted hydrocarbon group, such as methyl, ethyl, propyl, n-butyl, or phenyl.

The inhibitor moiety can also be substituted with other groups that do not adversely affect the desired properties of INH. For example, the inhibitor moiety can contain substituent groups that are hydrolyzable, such as those described in U.S. Pat. No. 4,477,563.

The timing group T and INH are selected and prepared to adjust to the activity of the adjoining coupler moiety, and the other groups of the coupler in order to optimize release of the INH for its intended purpose. Accordingly, useful INH groups have differing structural types that enable timing groups having a range of activities. Various properties, such as pKa, are also usefully considered in optimizing the selection of optimum groups for a particular purpose. An example of such a selection could involve, for instance, a benzotriazole moiety as an inhibitor. Such a benzotriazole moiety can be released too quickly for some intended purposes from a timing group that involves an intramolecular nucleophilic displacement mechanism; however, the benzotriazole moiety can be modified as appropriate by substituent groups that change the rate of release.

As to the coupler (B), the particular $R_1$ group linking the sulfur atom and the water solubilizing group $R_2$ can be varied to control such parameters as water solubility, diffusivity, silver affinity, silver ion complex solubility, silver development effects and other sensitometric effects. For example, $R_1$ can have more than one water solubilizing group, such as two carboxy groups. Since these parameters can be controlled by modification of $R_1$, they need not be emphasized in selecting a particular coupler moiety and the particular water solubilizing group, but provide freedom in selecting such moieties and groups for a particular photographic element and process.

In addition to yielding improvements in gamma-normalized granularity, coupler (B) tends to reduce the development inhibiting effect of DIR compounds (this includes essentially all DIR compounds, not just those represented by the formula for coupler (A)). This effect can be used to advantage in a number of ways, depending on how the various sensitometric properties of a photographic element are to be balanced. For example, the sharpness can be maintained while the amount of color correction can be reduced. Alternatively, greater amounts of DIR couplers can be used in a photographic element while maintaining the degree of color correction and tone control, so that improvements in image sharpness can be obtained. Also, desirable tone scale can be obtained while incorporating smaller quantities of silver halide, providing a more economical use of silver halide and improved image sharpness in the photographic element.

Other effects that coupler (B) can have are to reduce the susceptibility of the layer containing coupler (B) to development inhibitors released from other layers, thereby reducing interlayer interimage effects. Depending on the requirements of the photographic system, this can be highly desirable. Additionally, coupler (B) (especially when used in conjunction with coupler (A)) tends to increase the amount of dye formed from all couplers in the layer it is in, thereby increasing overall dye image efficiency.

In processing, the $-S-R_1-R_2$ fragment is released at an appropriate time as a unit. That is, $-S-R_1-R_2$ is released as a unit. The rate and total time of diffusion of the $-S-R_1-R_2$ fragment in the photographic element must be such as to enable, when used in combination with coupler (A), improvements in acutance and/or gamma-normalized granularity in the appropriate layers of the photographic element during processing. The timing group, when present, also releases $-S-R_1-R_2$ as a unit. Selection of $R_1$ and $R_2$ can also influence the rate and total time of release of the $-S-R_1-R_2$ moiety from the remainder of the compound, preferably the remainder of the coupler. It is preferable that the $-S-R_1-R_2$ moiety not adversely affect the processing steps and the photographic element.

Preferred photographic couplers of the invention are represented by the formula:

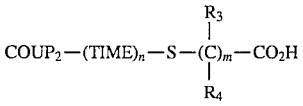

wherein $COUP_2$ and $(TIME)_n$ are as described above;

m is 1 to 8;

$R_3$ and $R_4$ are individually hydrogen or alkyl containing 1 to 4 carbon atoms; and wherein the total number of carbon atoms in

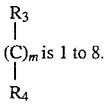

is 1 to 8.

Alkyl includes straight or branched chain alkyl, such as methyl, ethyl, n-propyl, i-propyl, n-butyl, and t-butyl. In one preferred embodiment, n is 0.

The $COUP_2$ coupler moiety can be any moiety as described above with respect to $COUP_1$, except of of course, that for $COUP_2$, Y would represent $-S-R_1-R_2$. The $-S-R_1-R_2$ moiety is attached at the coupling position of the coupler moiety that enables the $-S-R_1-R_2$ moiety to be displaced upon reaction of the coupler with oxidized color developing agent. In one preferred embodiment, $COUP_2$- is represented by the formula:

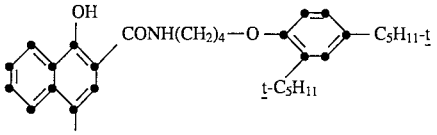

In $-S-R_1-R_2$ releasing couplers, the $-S-R_1-R_2$ moiety can be bonded to the remainder of the organic compound through a timing group (TIME). TIME in the described structures is a group that enables the timed release of $-S-R_1-R_2$ from COUP. The timing mechanism can be any timing mechanism that is useful for releasing photographically useful groups from coupler moieties. For example, the timing mechanism can be as described in, for example, U.S. Pat. Nos. 4,248,962 or 4,409,323, or German OLS 3,319,428. In one preferred embodiment, -TIME- is selected from the group consisting of:

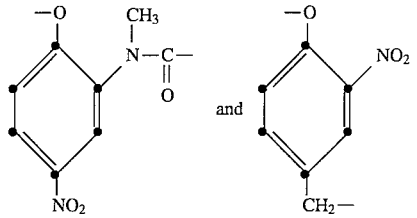

Release of the $-S-R_1-R_2$ moiety can involve a single reaction or it can involve sequential reactions. For example, two or more sequential reactions may be required within a TIME group to effect release of the $-S-R_1-R_2$ moiety. As another example, the TIME group can have two $-S-R_1-R_2$ moieties bonded to different locations on the TIME group so that upon release of the TIME group from the coupler moiety, two reactions can occur sequentially enabling sequential release of the two $-S-R_1-R_2$ moieties. Another example is a reaction in which the TIME group may release a second coupler moiety that contains another timing group to which a photographically useful group is attached and from which it is released after the second coupler moiety reacts with oxidized color developing agent.

The TIME group can contain moieties and substituents that will permit control of one or more of the rates of reaction of COUP with oxidized color developing agent, the rate of diffusion of $-TIME-S-R_1-R_2$ once it is released from COUP and the rate of release of $-S-R_1-R_2$. The TIME group can contain added substituents, such as added photographically useful groups, that can remain attached to the timing group and be released independently. The TIME groups can contain a ballast group.

The water-solubilizing groups useful as $R_2$ are groups well-known in the art that tend to increase or enhance the water solubility of organic compounds. $R_2$ can optionally be a precursor to a water solubilizing group. For example, $R_2$ can be an ester group, which upon hydrolysis forms a water solubilizing carboxylic acid group.

The following $R_2$ groups are examples of useful water solubilizing groups and their precursors:

—COOH $—COOCH_3$ $—COOC_2H_5$ $—NHSO_2CH_3$ $—SO_3H$

—OH

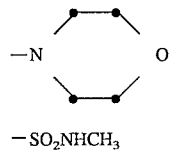

$—SO_2NHCH_3$

-continued

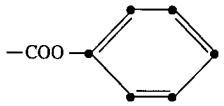

—$SO_2NH_2$

—$NR_5R_6$ wherein $R_5$ is H or alkyl of 1 to 4 carbons, $R_6$ is alkyl of 1 to 4 carbons and wherein at least one of $R_5$ and $R_6$ is alkyl, and the total carbon atoms in $R_5$ and $R_6$ is no more than 8.

The following are examples of useful $R_1$ groups:

$-CH_2-$ $-CH_2CH_2-$ $-CH_2CH_2CH_2-$ $-CH_2\underset{}{\overset{CH_3}{CH}}-CH_2-$ $-CH_2CH_2CH_2CH_2-$ $-CH_2\underset{C_2H_5}{CH}-CH_2CH_2-$ $-CH_2CH_2-\underset{CH_3}{CH}-CH_2-$ $-\underset{CH_3}{CH}-CH_2-$ $-CH_2CH_2OCH_2CH_2-$ Examples of $-R_1-R_2$ moieties include $-CH_2-CH_2-CO_2H$, $-CH_2-CH_2-O-CH_2-CH_2-OH$,

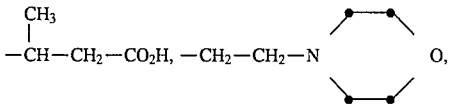

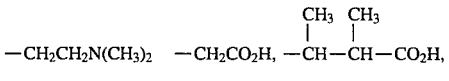

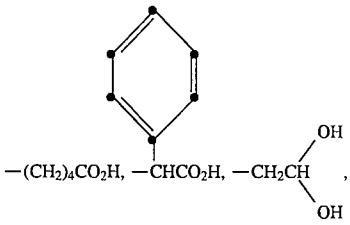

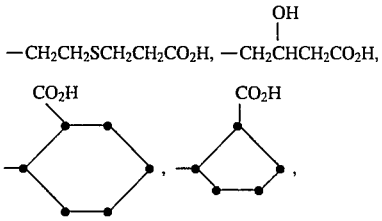

-continued

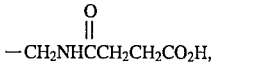

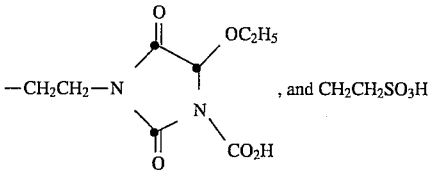

TIME groups that are useful enable release of the $-S-R_1-R_2$ moiety at the appropriate time during processing, that is at the time that enables, when used in combination with coupler (A), improvements in acutance and/or gamma-normalized granularity in the appropriate layers of the photographic element during processing. Examples of such TIME groups include:

A. Acyclic TIME groups:

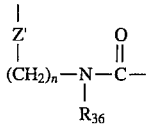

wherein n is 1 to 4;

Z' is

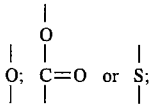

$R_{36}$ is hydrogen, alkyl, such as alkyl containing 1 to 20 carbon atoms; or aryl, such as aryl containing 6 to 20 carbon atoms, preferably unsubstituted phenyl or substituted phenyl.

B. Aromatic TIME groups:

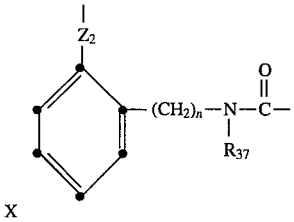

wherein n is 0 or 1;

$Z_2$ is

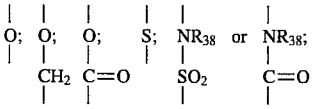

$R_{37}$ is hydrogen, alkyl, such as alkyl containing 1 to 20 carbon atoms; or aryl, such as aryl containing 6 to 20 carbon atoms, for example, phenyl;

$R_{38}$ is hydrogen, alkyl, such as alkyl containing 1 to 6 carbon atoms; or aryl, such as aryl containing 6 to 12 carbon atoms;

X is hydrogen; cyano; fluoro; chloro; bromo; iodo; nitro; alkyl, such as alkyl containing 1 to 20 carbon atoms; preferably methyl, ethyl, propyl or butyl; or aryl, such as aryl containing 6 to 20 carbon atoms, preferably unsubstituted phenyl or substituted phenyl.

Examples of specific couplers useful as coupler (B) include the following:

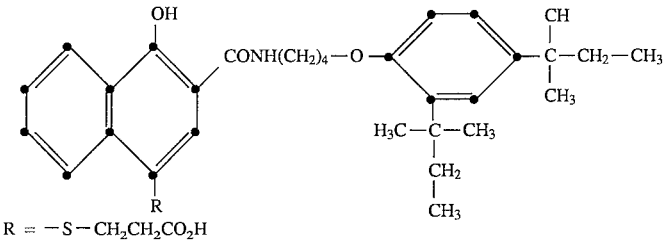

R = $-S-CH_2CH_2CO_2H$ B-1

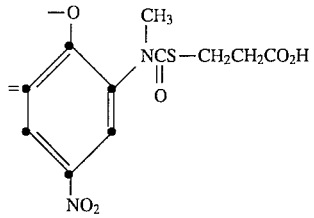

B-2

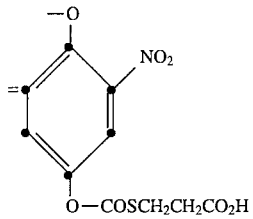

B-3

= $-S-CH(CH_3)CH_2CH_2H$ B-4

= $-S-CH_2CH_2OCH_2CH_2OH$ B-5

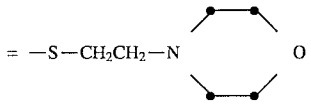

B-6

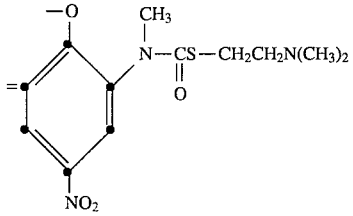

B-7

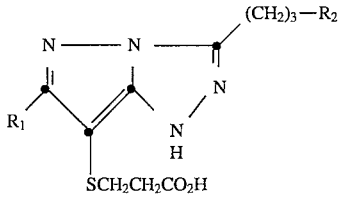

$R_1 = -CH_3$;

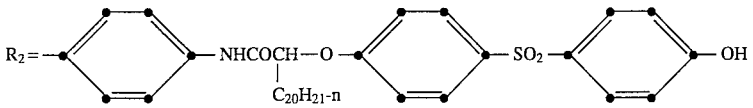

B-8

-continued
B-9
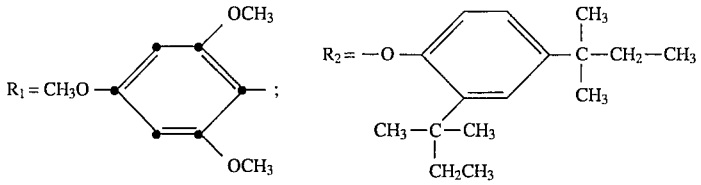
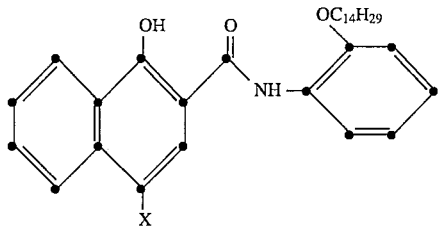
$X = S-CH_2-CH_2-CO_2H$ B-10
$X = S-CH_2-CO_2H$ B-11
B-12
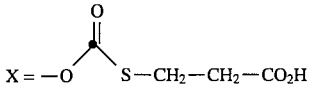
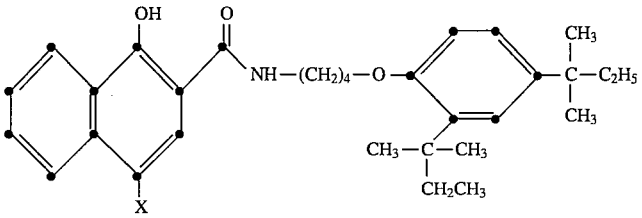
$X = -CH_2-CO_2H$ B-13
B-14
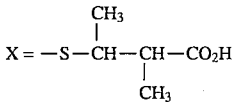
B-16
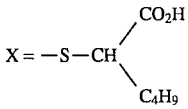
$X = S-(CH_2)_4-CO_2H$ B-17
$X = -S-CH-CO_2H$ B-18
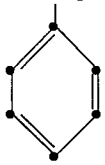
$X = -S-CH_2CHOH$ B-19
$CH_2OH$
$X = -S-CH_2-CH_2-O-CH_2-CH_2-CO_2H$ B-20
B-21
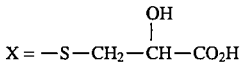
B-22
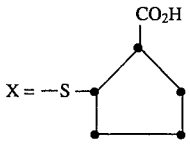

-continued
B-23
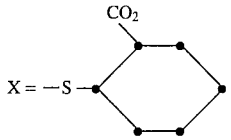
B-24
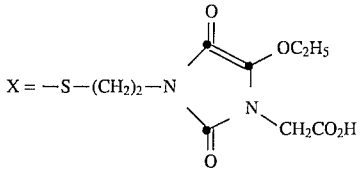
B-25
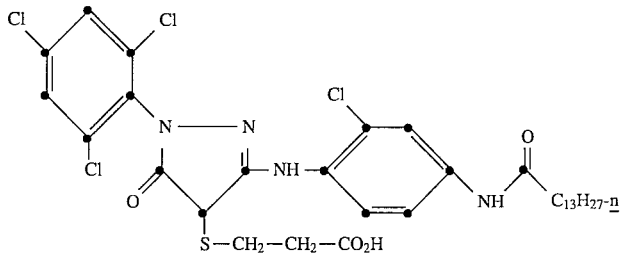
B-26
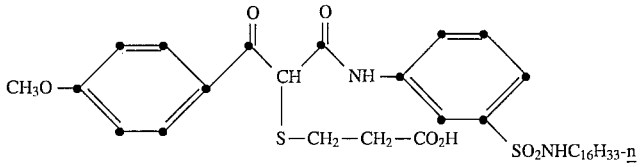
B-27
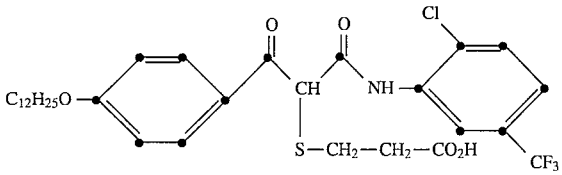
B-28
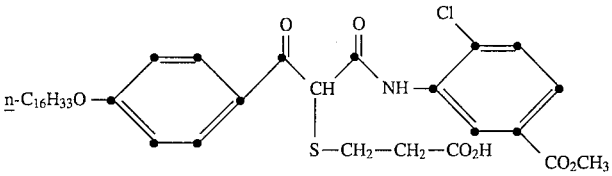
B-29
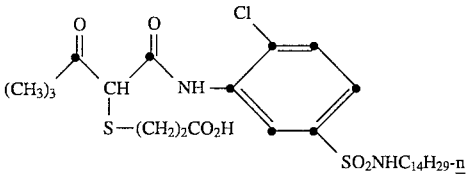
B-30
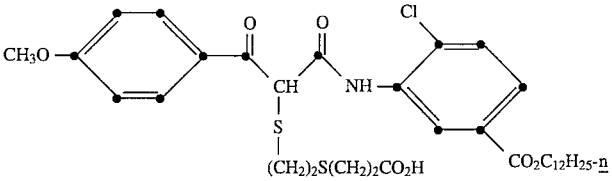

-continued
B-31
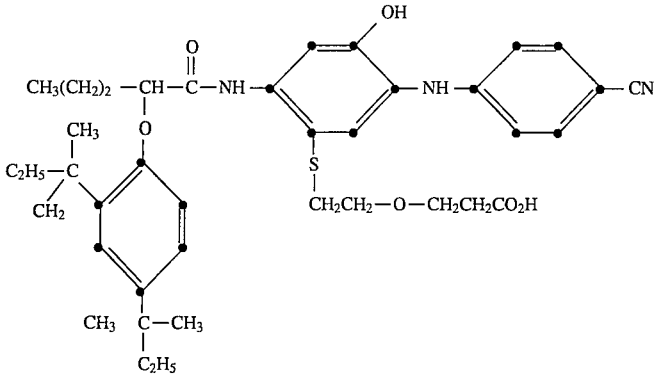
B-32
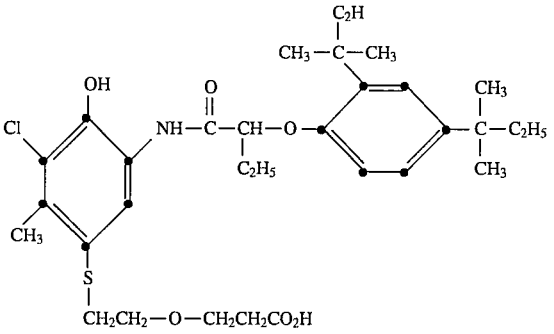
B-33
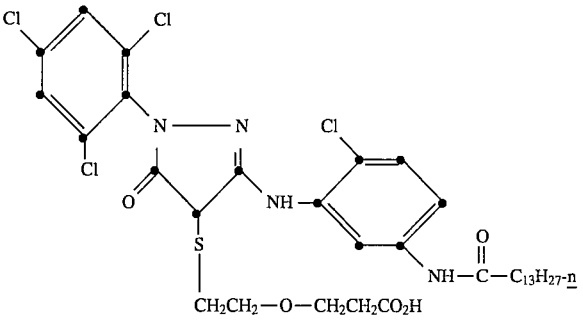
B-34
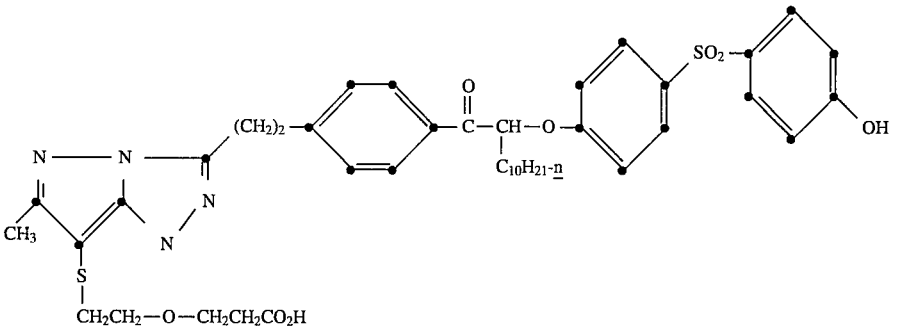

-continued

B-35

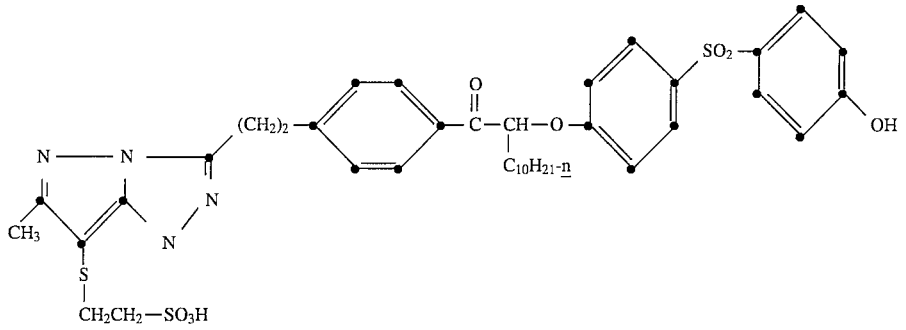

Couplers as described herein can be prepared by methods known in the organic compound synthesis art. A typical synthesis involves first attaching the timing group (if any) to the appropriate coupler moiety, or a derivative of the coupler moiety. The product is then reacted with an appropriate derivative of the inhibitor to form the desired coupler. Known reactions are employed to perform these steps. The following synthesis examples illustrate the way in which these steps can be performed using specific reactants and reactions.

Synthesis Example 1

This relates to the synthesis of the (B) coupler B-1:

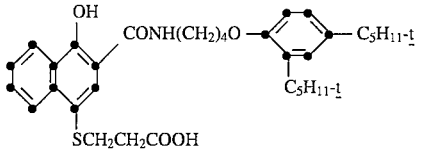

To a solution of 5 g (9.9 mmol) of the coupler moiety:

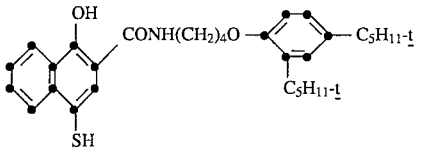

in 75 mL of tetrahydrofuran, stirred under nitrogen, is added 1.4 g (9.9 mmol) of tetramethylguanidine and then 1.1 mL (9.9 mmol) of ethyl acrylate. After 30 minutes 50 mL of methanol and 10 mL of 1.25N sodium hydroxide solution are added and the resulting composition stirred for 15 minutes. The mixture is then drowned in ice-cold dilute hydrochloric acid. The desired product is extracted and purified. For example, the desired product is extracted with diethyl ether to obtain, after crystallization, the desired coupler, which is a colorless solid having a melting point of 139° C. to 141° C. The product is also identified by elemental and spectral analysis.

Synthesis Example 2

This example relates to the synthesis of an (A) coupler A-2.

Coupler A-2

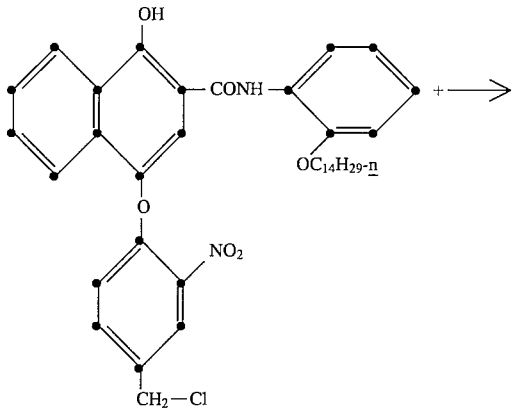

S-7

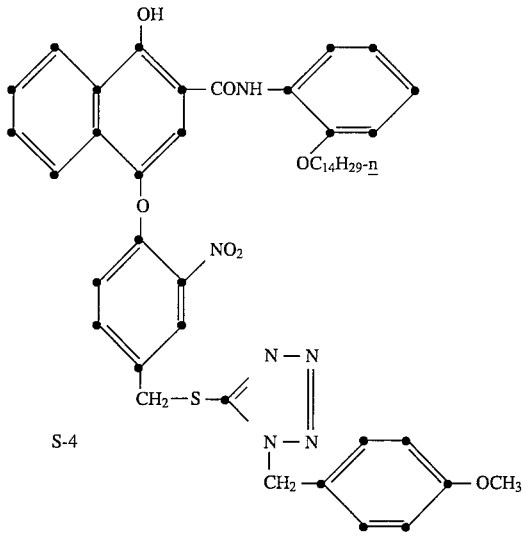

S-4

A mixture of 6.6 g (10 mmole) benzyl chloride (S-7), 2.2 g (10 mmole) 4-methoxybenzyl mercaptotetrazole (S-2), 0.84 g, (10 mmole) sodium bicarbonate, and 0.05 g tetrabutylammonium bromide in 50 ml dichloromethane and 30 ml water was stirred at room temperature for 18 hours at which time an additional 0.44 g (S-4 and 0.12 g sodium bicarbonate was added. After four more hours, the organic layer was separated, dried over anhydrous magnesium sulfate, filtered, and concentrated in vacuo. The resulting oil was chromatographed over silica (dichloromethane) and the product-containing eluants were combined and concentrated in vacuo to yield an oil which was crystallized from acetic acid to yield 3.0 g of the desired product, m.p. 75°–6° C. The elemental analysis was correct for structure indicated.

Calculated: C, 66.6; H, 6.4; N, 9.9; S, 3.8; Found: C, 66.7; H, 6.7; N, 9.9; S, 3.6.

Additional synthesis examples of (A) couplers can be found in the above-referenced U.S. Pat. No. 4,409,323. Additional synthesis examples of (B) couplers can be found in European Patent Application Publication No. 193,389, the disclosure of which is incorporated herein by reference.

The couplers described herein can be incorporated in photographic elements and/or in photographic processing solutions, such as developer solutions, so that upon development of an exposed photographic element they will be in reactive association with oxidized color developing agent and each other. Coupler compounds incorporated in photographic processing solutions should be of such molecular size and configuration that they will diffuse through photographic layers with the processing solution. When incorporated in a photographic element, as a general rule, the coupler compounds should be nondiffusible, i.e., they should be of such molecular size and configuration that they will not significantly diffuse or wander from the layer in which they are coated.

Photographic elements as described can be processed by conventional techniques in which color forming couplers and color developing agents are incorporated in separate processing solutions or compositions or in the element.

Photographic elements in which the coupler (A) is incorporated can be a simple element comprising a support and a single silver halide emulsion layer or they can be multilayer, multicolor elements. The coupler (A) can be incorporated in at least one of the silver halide emulsion layers and/or in at least one other layer, such as an adjacent layer, where it will come into reactive association with oxidized color developing agent that has developed silver halide in the emulsion layer. The coupler (B) can be in the same layer as the coupler (A) or in a different layer, such as an adjacent layer, so that the two couplers are in reactive association with each other during processing.

The silver halide emulsion layer can contain or have associated with it, other couplers, such as dye-forming couplers, colored masking couplers, and/or competing couplers. These other photographic couplers can form dyes of the same or different color and hue as the photographic couplers of this invention. Additionally, the silver halide emulsion layers and other layers of the photographic element can contain addenda conventionally contained in such layers.

A typical multilayer, multicolor photographic element as described can comprise a support having thereon a red-sensitive silver halide emulsion unit having associated therewith a cyan dye image providing material, a green-sensitive silver halide emulsion unit having associated therewith a magenta dye image providing material and a blue-sensitive silver halide emulsion unit having associated therewith a yellow dye image-providing material, at least one of the silver halide emulsion units having associated therewith coupler (A) as described. Each silver halide emulsion unit can be composed of one or more layers and the various units and layers can be arranged in different locations with respect to one another.

If $COUP_1$, T, INH, $COUP_2$, TIME, and/or $-S-R_1-R_2$ are diffusible moieties, the layer or unit affected by INH and/or $-S-R_1-R_2$ can be controlled by incorporating in appropriate locations in the element a scavenger layer that will confine the action of $COUP_1$, T, INH, $COUP_2$, TIME, and/or $-S-R_1-R_2$ to the desired layer or unit. At least one of the layers of the photographic element can be, for example, a mordant layer or a barrier layer.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromolodide and mixtures thereof. The emulsions can be negative-working or direct-positive emulsions. They can form latent images predominantly on the surface of the silver halide grains or predominantly on the interior of the silver halide grains. They can be chemically and spectrally sensitized. Examples of emulsions and their preparation are described in *Research Disclosure*, Item 17643, December, 1978 [hereinafter *Research Disclosure I*]. The emulsions typically will be gelatin emulsions although other hydrophilic colloids are useful, as described in *Research Disclosure I*. Tabular grain light sensitive silver halides are particularly useful such as described in *Research Disclosure*, January 1983, Item No. 22534 and U.S. Pat. No. 4,434,226.

The support can be any support used with photographic elements, as described in *Research Disclosure I*. Typical supports include cellulose nitrate film, cellulose acetate film, polyvinylacetal film, polyethylene terephthalate film, polycarbonate film and related films or resinous materials as well as glass, paper, metal and the like. Generally, a flexible support is employed, such as a polymeric film or paper support. Paper supports can be acetylated or coated with baryta and/or an α-olefin polymer, particularly a polymer of an α-olefin containing 2 to 10 carbon atoms such as polyethylene, polypropylene, ethylene-butene copolymers, and the like.

The photographic elements of this invention or individual layers thereof, can contain brighteners (see *Research Disclosure I*, Section V), antifoggants and stabilizers (see *Research Disclosure I*, Section VI), antistain agents and image dye stabilizer (see *Research Disclosure I*, Section VII, paragraphs I and J), light absorbing and scattering materials (see *Research Disclosure I*, Section VIII), matting agents (see *Research Disclosure I*, Section XVI) and development modifiers (see *Research Disclosure I*, Section XXI).

Photographic elements can be exposed to actinic radiation, usurally in the visible region of the spectrum, to form a latent image as described in *Research Disclosure I*, Section XVIII and then processed to form a visible dye image as described in *Research Disclosure I*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

With negative working silver halide a negative image can be formed. Optionally positive (or reversal) image can be formed.

Development is followed by the conventional steps of bleaching, fixing, or bleach-fixing, to remove silver and silver halide, washing and drying.

The following examples further illustrate the invention.

Coupler (A) can be used in photographic elements in the same way as photographic couplers that release inhibitors have previously been used in photographic elements.

Depending upon the nature of the particular INH, the coupler (A) (and coupler (B)) can be incorporated in a photographic element for different purposes and in different locations.

The range of operation between layers of the moieties released from the couplers as described can be controlled by the use of scavenger layers, such as a layer of fine grain silver halide emulsion. Scavenger layers can be in various locations in an element containing couplers as described. They can be located between layers, between the layers and the support, or over all of the layers.

The invention is further illustrated by the following examples:

EXAMPLE

Photographic elements were prepared according to the following format:

| |
|---|
| gelatin (500 mg/ft$^2$)<br>bisvinylsulfonylmethyl ether (1.75% of total gel) |
| AgI(6.4%)Br(93.6%) 150 mg/ft$^2$)<br>dye-forming coupler* (at levels indicated in Table I)<br>DIR coupler as indicated in Table I<br>coupler (B) as described in Table I<br>gelatin (350 mg/ft$^2$) |
| / / /

TABLE I

| Coating | Image-forming Coupler Level ($mg/ft_2$) | DIR Coupler Level ($mg/ft_2$) | Coupler (B) Level ($mg/ft_2$ granularity | Gamma-normalized Granularity | Reduction in gamma-normalized |
|---|---|---|---|---|---|
| 2A | 70 | D-2, 5.0 | — | 15.9 | — |
| 2B | 60 | D-2, 5.0 | B-1, 5.0 | 14.2 | — |
| Comparison | — | — | — | — | 1.7 |
| 2C | 70 | A-2, 6.0 | — | 18.6 | — |
| 2D | 55 | A-2, 6,0 | B-1, 5.0 | 15.9 | — |
| Invention | — | — | — | — | 2.7 |

D-2

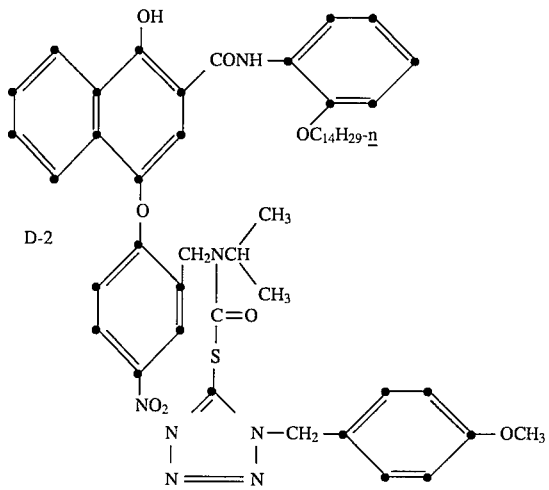

The results in Table I show that for elements having matched density and contrast performance, the coupler (B) used according to the invention yields greater reductions in when used in conjunction with a DIR coupler (A) compound than when used in conjunction with other DIR couplers, such as the DIR couplers D-1 or D-2.

The invention has been described in detail with particular reference to preferred embodiments thereof, but it will be understood that variations and modifications can be effected within the spirit and scope of the invention.

What is claimed is:

1. A photographic element comprising a support having thereon at least one photographic silver halide emulsion layer, in reactive association with the silver halide emulsion:

a) a first coupler represented by the formula:

$COUP_1$-T-INH wherein $COUP_1$ is a coupler moiety, T is a timing group bonded to INH through a substituted or unsubstituted methylene group contained in T and bonded to $COUP_1$ through an O, S, or N atom contained in T, and INH is a development inhibitor moiety, and wherein the T-INH group is able to undergo electron transfer along a conjugated system therein to cleave INH after T-INH is cleaved from $COUP_1$, and b) a second coupler represented by the formula:

$$COUP_2-(TIME)_n-S-\underset{R_4}{\overset{R_3}{(C)_m}}-CO_2H$$

wherein $COUP_2$ is a coupler moiety, TIME is a timing group, n is 0 or 1, m is 1 to 8, $R_3$ and $R_4$ each independently represent hydrogen or alkyl of from 1 to 4 carbon atoms, and the sum of m and the number of carbon atoms represented by both $R_3$ and $R_4$ is 1 to 8.

2. A photographic element according to claim 1 wherein the second coupler is represented by the formula:

$$COUP_2-S-\underset{R_4}{\overset{R_3}{(C)_m}}-CO_2H$$

wherein $COUP_2$ is a coupler moiety, m is 1 to 8, $R_3$ and $R_4$ each independently represent hydrogen or alkyl of from 1 to 4 carbon atoms, and the sum of m and the number of carbon atoms represented by both $R_3$ and $R_4$ is 1 to 8.

3. A photographic element according to claim 1 wherein the second coupler is represented by the formula:

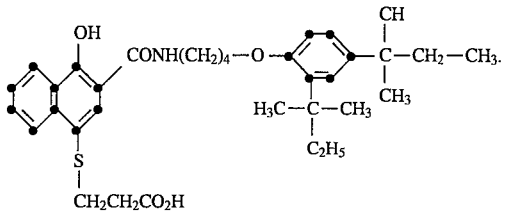

4. A photographic element comprising a support having thereon at least one photographic silver halide emulsion layer, in reactive association with the silver halide emulsion:

a) a first coupler represented by the formula:

$COUP_1$-T-INH wherein $COUP_1$ is a coupler moiety, T is a timing group bonded to INH through a substituted or unsubstituted methylene group contained in T and bonded to $COUP_1$ through an O, S, or N atom contained in T, and INH is a development inhibitor moiety, and wherein the T-INH group is able to undergo electron transfer along a conjugated system therein to cleave INH after T-INH is cleaved from $COUP_1$, and b) a second coupler represented by the formula:

$COUP_2$-$(TIME)_n$-S-$R_1$-$R_2$ wherein $COUP_2$ is a coupler moiety, TIME is a timing group, n is 0 or 1, -$R_1$-$R_2$ is selected from the group consisting of —$CH_2$—$CH_2$—$CO_2H$, —$CH_2$—$CH_2$—O—$CH_2$—$CH_2$—OH,

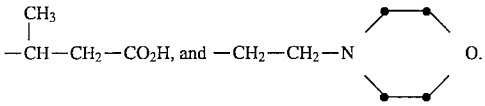

5. A photographic element according to any of claims 1, 2, 4 wherein $COUP_2$- is represented by the formula:

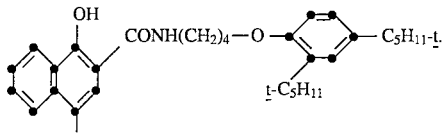

6. A photographic element according to claims 1 or 4 wherein -TIME- is selected from the group consisting of:

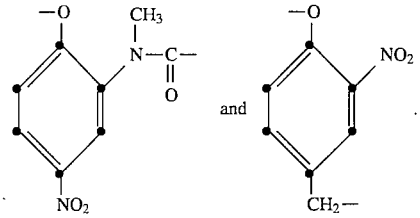

7. A photographic element comprising a support having thereon at least one photographic silver halide emulsion layer, in reactive association with the silver halide emulsion:

a) a first coupler represented by the formula:

$COUP_1$-T-INH wherein $COUP_1$ is a coupler moiety, T is a timing group bonded to INH through a substituted or unsubstituted methylene group contained in T and bonded to $COUP_1$ through an O, S, or N atom contained in T, and INH is a development inhibitor moiety, and wherein the T-INH group is able to undergo electron transfer along a conjugated system therein to cleave INH after T-INH is cleaved from $COUP_1$, and b) a second coupler represented by the formula:

$COUP_2$-$(TIME)_n$-S-$R_1$-$R_2$ wherein $COUP_2$ is a coupler moiety, TIME is a timing group, n is 0 or 1, $R_1$ is a divalent linking group that does not include a heterocyclic ring attached directly to S, and $R_2$ is a water solubilizing group, said first coupler also satisfying the formula:

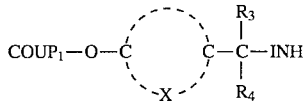

wherein X represents the atoms necessary to complete a substituted or unsubstituted benzene or naphthalene nucleus and $R_3$ and $R_4$ each independently represents H, alkyl, or aryl, and the

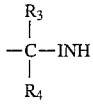

group is ortho or para relative to the oxygen atom.

8. A photographic element comprising a support having thereon at least one photographic silver halide emulsion layer, in reactive association with the silver halide emulsion:

a) a first coupler represented by the formula:

$COUP_1$-T-INH wherein $COUP_1$ is a coupler moiety, T is a timing group bonded to INH through a substituted or unsubstituted methylene group contained in T and bonded to $COUP_1$ through an O, S, or N atom contained in T, and INH is a development inhibitor moiety, and wherein the T-INH group is able to undergo electron transfer along a conjugated system therein to cleave INH after T-INH is cleaved from $COUP_1$, and b) a second coupler represented by the formula:

$COUP_2$-$(TIME)_n$-S-$R_1$-$R_2$ wherein $COUP_2$ is a coupler moiety, TIME is a timing group, n is 0 or 1, $R_1$ is a divalent linking group that does not include a heterocyclic ring attached directly to S, and $R_2$ is a water solubilizing group, wherein -T- is selected from the group consisting of:

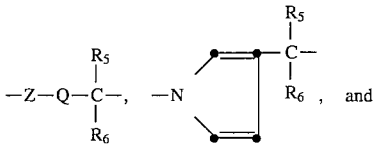

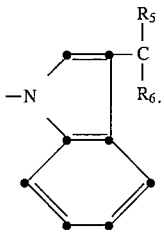

wherein —Z— is —O—, —S—, or

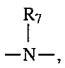

$R_5$, $R_6$, and $R_7$ are each independently hydrogen, alkyl, or aryl, and

Q is a 1,2- or 1,4-phenylene or naphthylene group.

9. A photographic element according to claim 8 wherein -T- is represented by the formula:

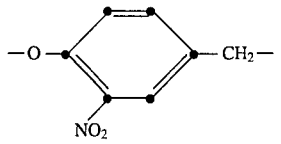

10. A photographic element comprising a support having thereon at least one photographic silver halide emulsion layer, in reactive association with the silver halide emulsion:

a) a first coupler represented by the formula:

$COUP_1$-T-INH wherein $COUP_1$ is a coupler moiety, T is a timing group bonded to INH through a substituted or unsubstituted methylene group contained in T and bonded to $COUP_1$ through an O, S, or N atom contained in T, and INH is a development inhibitor moiety, and wherein the T-INH group is able to undergo electron transfer along a conjugated system therein to cleave INH after T-INH is cleaved from $COUP_1$, and b) a second coupler represented by the formula:

$COUP_2$-$(TIME)_n$-S-$R_1$-$R_2$ wherein $COUP_2$ is a coupler moiety, TIME is a timing group, n is 0 or 1, $R_1$ is a divalent linking group that does not include a heterocyclic ring attached directly to S, and $R_2$ is a water solubilizing group, wherein INH is a mercaptotetrazole, selenotetrazole, mercaptobenzothiazole, selenobenzothiazole, mercaptobenzoxazole, selenobenzoxazole, mercaptobenzimidazole, selenobenzimidazole, benzotriazole or benzodiazole.

11. A photographic element according to any of claims 1–4 or 3–10 further comprising, in reactive association with the silver halide, a third coupler that is a dye-forming coupler.

12. A process of forming a photographic image comprising developing an exposed photographic silver halide layer with a color developing agent in the presence of:

a first coupler that is a dye forming coupler, a second coupler represented by the formula:

$COUP_1$-T-INH wherein $COUP_1$ is a coupler moiety, T is a timing group bonded to INH through a substituted or unsubstituted methylene group contained in T and bonded to $COUP_1$ through an O, S, or N atom contained in T, and INH is a development inhibitor moiety, and wherein the T-INH group is able to undergo electron transfer along a conjugated system therein to cleave INH after T-INH is cleaved from $COUP_1$, and a third coupler represented by the formula:

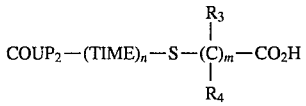

wherein $COUP_2$ is a coupler moiety, TIME is a timing group, n is 0 or 1, m is 1 to 8, $R_3$ and $R_4$ each independently represent hydrogen or alkyl of from 1 to 4 carbon atoms, and the sum of m and the number of carbon atoms represented by both $R_3$ and $R_4$ is 1 to 8.

13. A process of forming a photographic image comprising developing an exposed photographic silver halide layer with a color developing agent in the presence of:

a first coupler that is a dye forming coupler, a second coupler represented by the formula:

$COUP_1$-T-INH wherein $COUP_1$ is a coupler moiety, T is a timing group bonded to INH through a substituted or unsubstituted methylene group contained in T and bonded to $COUP_1$ through an O, S, or N atom contained in T, and INH is a development inhibitor moiety, and wherein the T-INH group is able to undergo electron transfer along a conjugated system therein to cleave INH after T-INH is cleaved from $COUP_1$, and a third coupler represented by the formula:

$COUP_2$-$(TIME)_n$-S-$R_1$-$R_2$ wherein $COUP_2$ is a coupler moiety, TIME is a timing group, n is 0 or 1, $R_1$ is a divalent linking group that does not include a heterocyclic ring attached directly to S, and $R_2$ is a water solubilizing group, said second coupler also satisfying the formula:

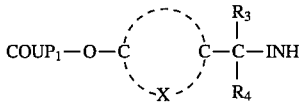

wherein X represents the atoms necessary to complete a substituted or unsubstituted benzene or naphthalene nucleus and $R_3$ and $R_4$ each independently represents H, alkyl, or aryl, and the

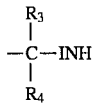

group is ortho or para relative to the oxygen atom.

14. A photographic element comprising a support having thereon:

at least one photographic silver halide emulsion layer; and, in reactive association with the silver halide emulsion, (a) a first coupler of the formula:

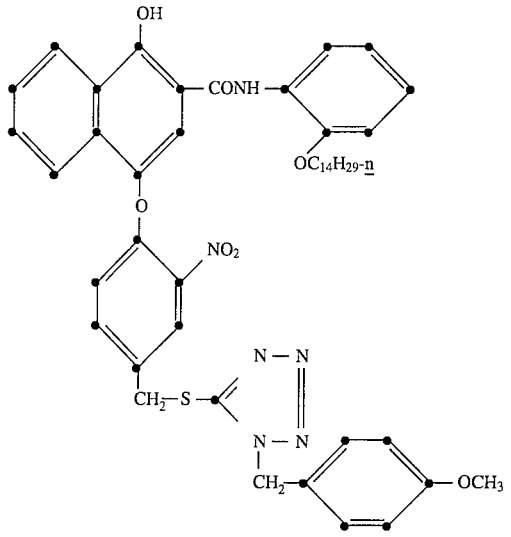

and (b) a second coupler represented by the formula:

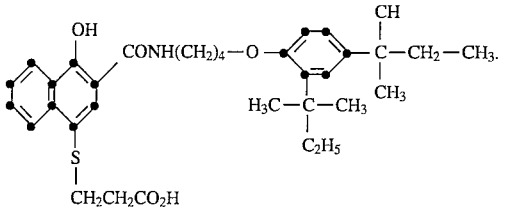

15. A silver halide color photographic material comprising at least one silver halide emulsion layer on a support wherein:

(a) at least one type of development inhibitor releasing type coupler is present which, by means of a coupling reaction with the oxidized form of a primary aromatic amine developing agent, releases a precursor of a second compound which inhibits the development of silver halide, and that precursor subsequently, by means of an electron transfer reaction via an ethylenic conjugated chain, releases said second compound, and (b) a coupler compound defined by the formula $COUP_2$-$(Time)_n$-S-$R_1R_2$ is present wherein:

(1) $COUP_2$ is a coupler moiety;

(2) Time is a timing group;

(3) n is 0 or 1;

(4) $R_1$ is a divalent linking group that does not include a heterocyclic ring attached directly to S; and (5) $R_2$ is a water solubilizing group.

16. A silver halide color photographic material as in claim 15, wherein the coupler (b) is represented by Formula I or Formula II:

$$A\text{-}(Time)_n\text{-}S\text{-}R_1\text{-}R_2 \qquad \text{Formula I}$$

$$A\text{-}(Time)_n\text{-}S\text{-}R_4\text{-}(R_3)_m \qquad \text{Formula II}$$

wherein:

(A) A represents the coupler residual group;

(b) Time represents a timing group;

(c) n is an integer of value 0 or 1;

(d) $R_1$ represents a divalent aliphatic group which has from 1 to 8 carbon atoms;

(e) $R_2$ represents a water soluble substituent group;

(f) $R_3$ represents a carboxyl group;

(g) m is an integer of value 1; and (h) $R_4$ is an ortho-cyclopentyl or ortho-cyclohexyl group.

17. A silver halide color photographic material as in claim 16, wherein:

(a) $R_2$ has no more than 8 carbon atoms and (b) $R_2$ contains at least one group selected from among carboxyl groups, sulfo groups, hydroxyl groups, substituted amino groups, ethoxy groups, sulfonamido groups, and sulfamoyl groups as substituent groups.

18. A silver halide color photographic material as in claim 12, wherein $R_1$ and $R_2$ together are —$CH_2CH_2$—S—$CH_2CH_2COOH$.

19. A silver halide color photographic material as in claim 15, wherein the development inhibitor releasing type couplers are represented by formula V:

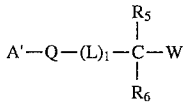

Formula V wherein:

(a) A' represents a coupler residual group which releases the remaining section of the molecule including Q on undergoing a coupling reaction with the oxidized form of a primary aromatic amine developing agent;

(b) Q represents an oxygen atom, sulfur atom, or imino group;

(c) L represents a conjugated system;

(d) l is an integer of value 1;

(e) $R_5$ and $R_6$ each independently represent a hydrogen atom, an alkyl group, or an aryl group; and (f) W represents a component which inhibits the development of silver halide.

20. A silver halide color photographic material as in claim 19, wherein the development inhibitor releasing type couplers are represented by Formula VIII or Formula IX:

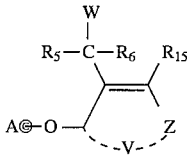

Formula VIII

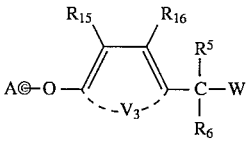

Formula IX wherein:

(a) A', $R_5$, $R_6$, and W have the same significance as A', $R_5$, $R_6$, and W in general formula V;

(b) $V_3$ represents a non-metallic atomic group which is required to form, along with the linked atomic groups, a benzene ring;

(c) Z represents a substituted or unsubstituted methine group; and (d) $R_{15}$ and $R_{16}$ each independently represent a univalent group.

21. A silver halide color photographic material as in claim 15, wherein the coupler compound (b) is represented by the formula:

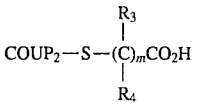

wherein:

(1) $COUP_2$ is a coupler moiety;

(2) m is 1 to 8;

(3) $R_3$ and $R_4$ each independently represent:

(i) hydrogen, or (ii) alkyl of 1 to 4 carbon atoms; and the sum of m and the number of carbon atoms represented by both $R_3$ and $R_4$ is 1 to 8.

22. A silver halide color photographic material as in claim 15, wherein the coupler compound (b) is represented by the formula:

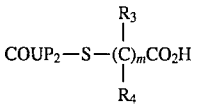

wherein:

(1) $COUP_2$ is a coupler moiety;

(2) m is 2; and (3) $R_3$ and $R_4$ each independently represent:

(i) hydrogen or (ii) alkyl of 1 to 4 carbon atoms.

23. A silver halide color photographic material as in claim 15, wherein the coupler compound (b) is represented by the formula:

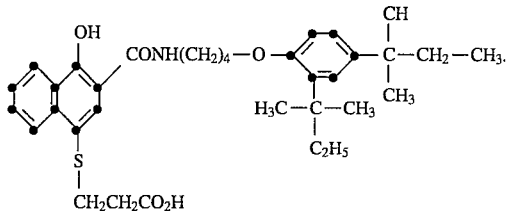

* * * * *